US007032542B2

(12) United States Patent
Donnelly et al.

(10) Patent No.: US 7,032,542 B2
(45) Date of Patent: Apr. 25, 2006

(54) APPARATUS AND METHODS FOR CONTROLLING A WATER HEATER

(75) Inventors: Donald E. Donnelly, Fenton, MO (US); Thomas P. Buescher, St. Louis, MO (US); Michael Somorov, University City, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/863,319

(22) Filed: Jun. 8, 2004

(65) Prior Publication Data

US 2005/0279291 A1 Dec. 22, 2005

(51) Int. Cl.
*H05B 3/02* (2006.01)

(52) U.S. Cl. ..... 122/14.2; 219/483

(58) Field of Classification Search ..... 122/14.1, 122/14.2, 14.22, 447; 237/8 R; 219/483
See application file for complete search history.

(56) References Cited

U.S. PATENT DOCUMENTS 4,151,090 A * 4/1979 Brigante ..... 210/222
4,178,907 A * 12/1979 Sweat, Jr. ..... 261/39.1
4,662,390 A * 5/1987 Hawkins ..... 137/392
4,684,061 A * 8/1987 Subherwal ..... 236/20 R
4,768,947 A * 9/1988 Adachi ..... 431/80
4,995,415 A * 2/1991 Weber ..... 137/1
5,092,519 A 3/1992 Staats
5,367,602 A * 11/1994 Stewart ..... 392/308
5,419,308 A * 5/1995 Lee ..... 122/14.21
6,139,311 A * 10/2000 Bowman et al. ..... 431/278
6,261,087 B1 7/2001 Bird et al.
6,390,028 B1 5/2002 Langmead et al.
6,401,669 B1 * 6/2002 Macgowan et al. ..... 122/448.1
6,465,764 B1 * 10/2002 Shahin ..... 219/486
6,701,874 B1 * 3/2004 Schultz et al. ..... 122/14.2
6,722,876 B1 4/2004 Abraham et al.
2002/0132202 A1 9/2002 Clifford

* cited by examiner

*Primary Examiner*—Gregory Wilson
(74) *Attorney, Agent, or Firm*—Harness, Dickey & Pierce, P.L.C.

(57) ABSTRACT

A gas-powered water heater includes means for stepping down a line voltage from a receptacle remote from the tank, means for using the stepped down voltage to provide a low voltage, and means for using the low voltage to sense conditions pertaining to the heater and to control heater operation based on the sensed conditions. Using a plug-in transformer to provide power for microprocessor control makes it unnecessary to install a line voltage line to the heater.

27 Claims, 3 Drawing Sheets

APPARATUS AND METHODS FOR CONTROLLING A WATER HEATER

FIELD OF THE INVENTION

The present invention relates generally to gas furnaces and, more particularly, processor control of a water heater.

BACKGROUND OF THE INVENTION

In gas-powered furnace systems, sensors of various types are commonly used to provide information for controlling system operation. In residential water heaters, for example, an immersion sensor may be used inside a water tank to monitor water temperature. Commercial water heaters, which typically operate at higher temperatures than residential units, may have a pair of immersion sensors, one at the tank top and one at the tank bottom. Bottom and top sensors typically are monitored relative to a set-point temperature and a temperature range. Heating typically is stopped when the water temperature reaches the set-point temperature and is initiated when the temperature drops below the temperature range.

Water heaters also frequently are configured with flammable vapor (FV) sensors for detecting presence of a flammable vapor. Vapor presence may be detected by using a signal comparator to monitor the resistance level of an FV sensor. For example, where a typical FV sensor resistance might be approximately 10,000 ohms, such resistance could rapidly increase to approximately 50,000 ohms in the presence of a flammable vapor. If the FV sensor exhibits a high resistance as sensed by the signal comparator, gas supply to the heater typically is shut off.

The inventors have observed, however, that FV sensors may undergo changes in resistance due to general ageing, even in a mild environment. Chemical vapors, e.g., chlorines commonly found in household bleaches, can accelerate this process. Over time, a FV sensor may gradually exhibit increased resistance sufficient to cause a false shut-down of a furnace system. On the other hand, the inventors have observed that resistance of a FV sensor may diminish gradually over time, possibly to such a low level that it might not trip a shut-down of a heating system if a flammable vapor event were to occur.

In view of the foregoing, it has become apparent to the inventors that using processor-supplied logic to process sensor inputs and to control heater operation provides opportunities for improving the efficiency and safety of water heater operation. Heating systems are known in which operating power is supplied to a microprocessor by a thermoelectric generator connected to a pilot burner. Such a generator, however, might not be able to generate voltages high enough to operate the processor, unless energy output by the pilot burner is increased.

SUMMARY OF THE INVENTION

The present invention, in one embodiment, is directed to a gas-powered water heater having a burner that heats water in a tank. The system includes means for stepping down a line voltage from a line voltage receptacle remote from the tank to provide a stepped down voltage. The system also has means for using the stepped down voltage to provide a low voltage lower than the stepped down voltage; and means for using the low voltage to sense a plurality of conditions pertaining to the heater and to control heater operation based on the sensed conditions.

Further areas of applicability of the present invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of embodiments of the invention is merely exemplary in nature and is in no way intended to limit the invention, its application, or uses.

Figure 1:
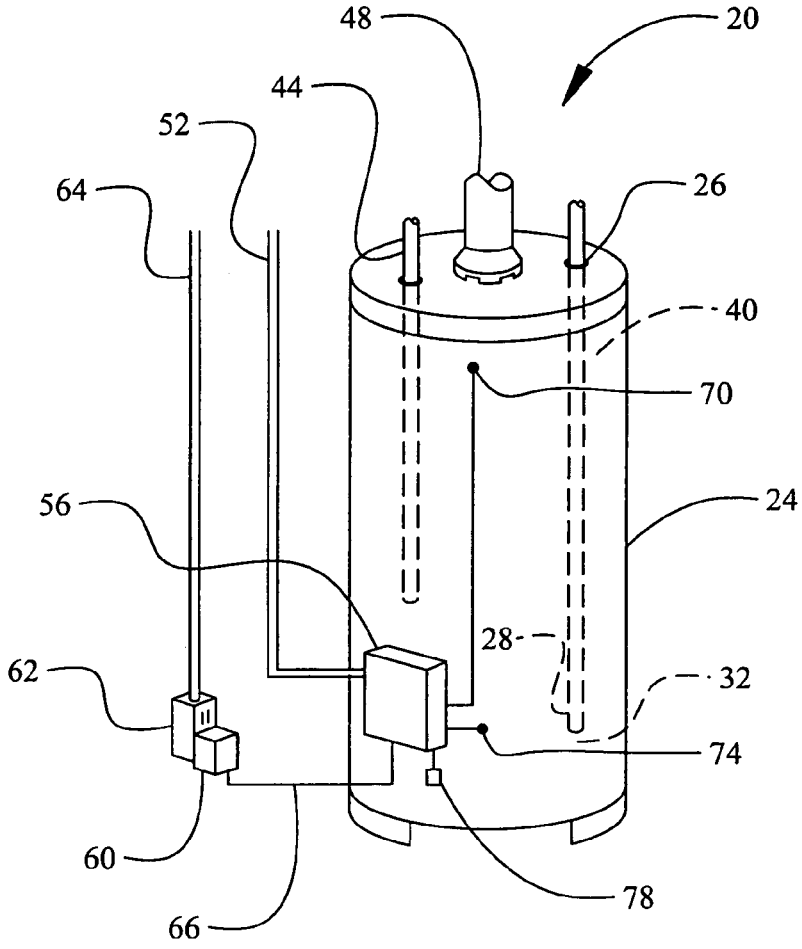
FIG. 1 is a perspective view of a water heater according to one embodiment of the present invention.

A gas water heater according to one embodiment of the present invention is indicated generally by reference number 20 in FIG. 1. The heater 20 has a tank 24 into which cold water enters via a cold water inlet pipe fitting 26 and cold water inlet 28. Cold water entering the bottom 32 of the tank is heated by a gas burner (not shown) beneath the tank. The burner can be lighted, for example, using an igniter (not shown in FIG. 1). Heated water rises to the top 40 of the tank and leaves the tank via a hot water pipe 44. Combustion gases leave the heater via a flue 48. An electrically operated solenoid gas valve (not shown in FIG. 1) controls gas flow through a gas supply line 52 to the burner as further described below.

An apparatus for controlling the heater 20 includes a controller 56 positioned, for example, adjacent the tank 24. As further described below, the controller 56 is configured to sense flammable vapors, water temperature at the top 40 of the tank 24, and water being drawn from the tank. The controller 56 also can responsively activate or deactivate the igniter and the gas valve, as further described below.

A 24-volt plug-in transformer 60 is plugged into a line voltage source, e.g., a receptacle outlet 62 of a 120 VAC line 64. Thus the transformer 60 can be plugged into a voltage source remote from the controller 56 and remote from the tank 24. Conductive wiring 66 connects the transformer 60 with the controller 56. The transformer steps down the line voltage to provide a stepped-down voltage to the controller 56. In other embodiments, line and stepped-down voltages may differ from those described in the present configuration.

A surface-mounted temperature sensor 70 connected to the controller 56 senses water temperature near the top of the tank 24. To prevent scalding, the controller 56 can shut off the heater 20 if the sensor 70 senses a temperature exceeding a predetermined maximum. A surface-mounted water-draw sensor 74 is configured with the controller 56 to sense water being drawn from the tank. More specifically, in the configuration shown in FIG. 1, the sensor 74 is a temperature sensor at the bottom of the tank 24 near the cold water inlet 28. Cold water entering the tank 24 thus affects sensor 74 output. A flammable vapor (FV) sensor 78 is surface-mounted, for example, on the tank bottom 32 and connected with the controller 56.

Figure 2:
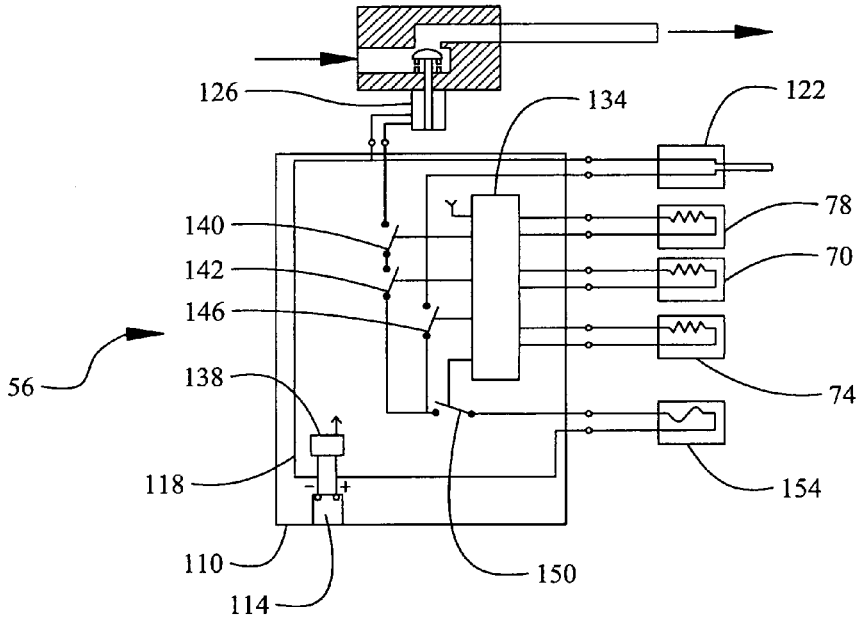
FIG. 2 is a schematic diagram of a water heater controller according to one embodiment of the present invention.

The controller 56 is shown in greater detail in FIG. 2. A board 110 includes an inlet 114 for connection of the transformer 60 to the board via the conductor 66. The transformer 60 provides a stepped-down 24 VAC supply to a circuit 118 that provides operating power, for example, to an igniter 122 and a gas valve 126. The gas valve 126, for example, is solenoid-operated to control the flow of gas to a burner outlet (not shown).

The circuit 118 also provides operating power to a processor 134, e.g., a microprocessor that receives input from the sensors 70, 74 and 78 and that controls activation of the igniter 122 and gas valve 126. The processor 134 draws a low voltage, e.g., 5 VDC, from a 5-volt power supply 138 to control heater operation. Other voltages for the processor 134 and/or power supply 138 are possible in other configurations. In the present invention, the power supply is preferably a small transformer and zener diode circuit.

The processor 134 controls at least one solenoid gas valve switch, and in the present invention, controls a pair of switches 140 and 142 for operating the gas valve 126. The processor 134 also controls an igniter switch 146 for operating the igniter 122. A flammable vapor switch 150 can be activated by the processor 134 to interrupt the 24-volt power supply to the igniter 122 and gas valve 126, in response to a signal from the FV sensor 78 indicative of undesirable flammable vapors. A thermal fuse 154 in the stepped-down voltage circuit 118 interrupts the 24-volt supply if water temperature exceeds a predetermined upper limit. Thus the fuse 154 serves as a backup for the temperature sensor 70 to prevent excessively high water temperatures.

The controller 56 monitors temperature change as signaled by the sensor 74. If the controller 56 determines, for example, that a rapid drop in temperature has occurred, then the controller 56 determines that water is being drawn from the tank 24 and controls the heater 20 accordingly as further described below. What may constitute a "rapid" drop in temperature can be predefined and stored in the processor 134. It can be appreciated that sensitivity can be programmed into the processor 134 to avoid a call for heat on every water draw.

In another configuration, the sensor 74 may be a temperature sensor surface-mounted on the cold water inlet fitting 26. During a stand-by period (a period during which heating is not performed), temperature of the cold water inlet fitting 26 tends to be similar to temperature of hot water in the tank 24. When cold water is drawn into the tank 24, temperature of the cold water inlet fitting 26 tends to drop rapidly. What may constitute a "rapid" drop in temperature can be predefined and stored in the processor 134. In other configurations, the sensors 70 and 74 could be positioned in other locations appropriate for monitoring temperature change indicative of water being drawn from the tank.

Figure 3:
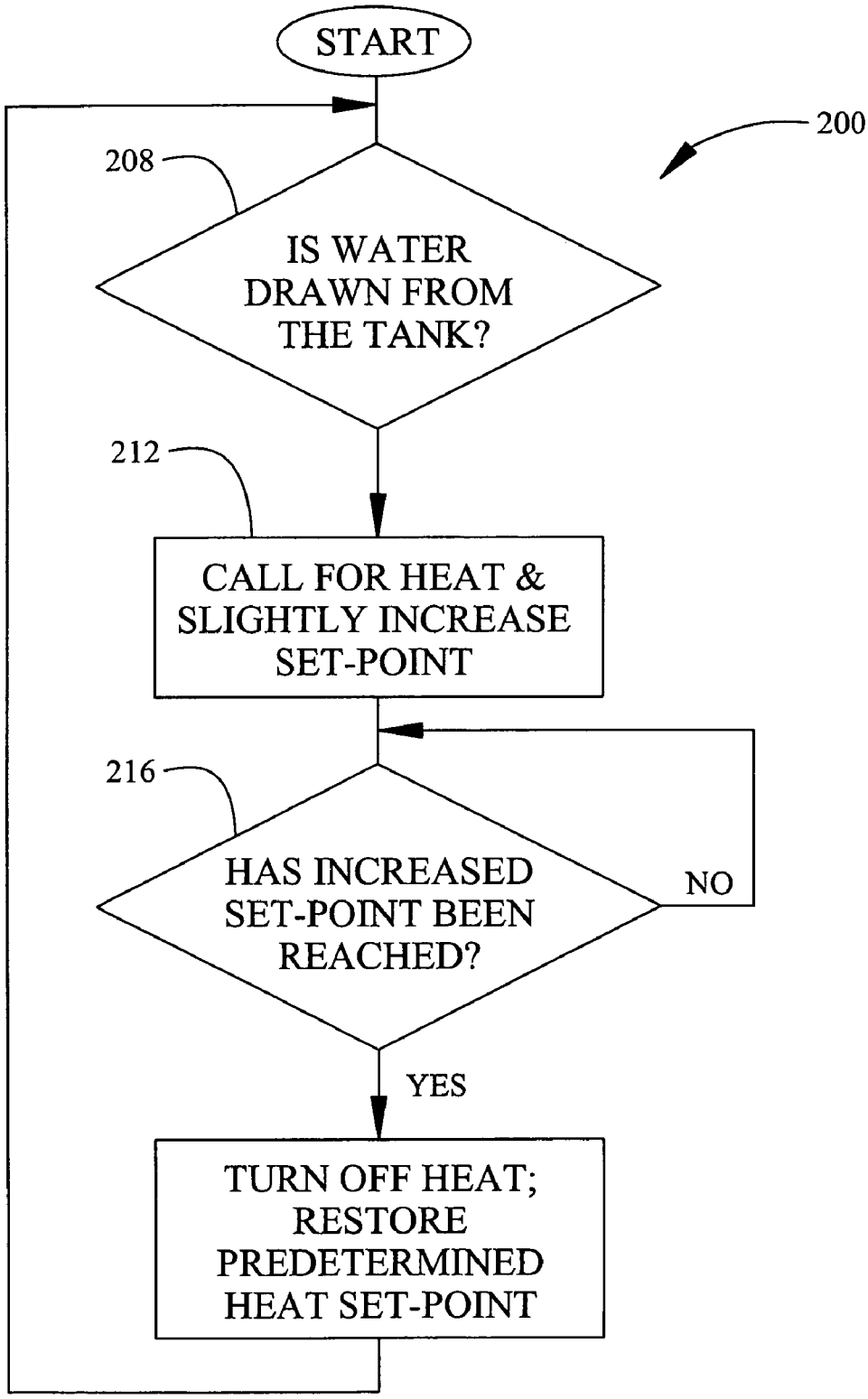
FIG. 3 is a flow diagram of a method of controlling a water heater according to one embodiment of the present invention.

The controller 56 can control heater operation using an exemplary method indicated generally by reference number 200 in FIG. 3. At step 208, the processor 134 uses input from the water-draw sensor 74 to determine whether water has been drawn from the tank 24. If cold water is entering the tank, then at step 212 the processor 134 calls for heat and slightly increases a predetermined set-point at which heating is to be shut off and a stand-by mode is to be entered. In the present exemplary embodiment, to "slightly" increase the set-point means to increase the set-point by about 1 to 5 degrees F. The set-point is increased to provide for a case in which the temperature sensor 70 has already sensed the predetermined shut-off set-point temperature. At step 216 the processor uses input from the temperature sensor 70 to determine whether the increased set-point has been reached. If no, heating is continued. If yes, then at step 220 the processor 134 discontinues heating, restores the predetermined shut-off set-point and returns to step 208.

An exemplary sequence shall now be described. A shut-off set-point may be predetermined to be 120 degrees F. with a 10-degree F. differential. The heater 20 is in stand-by mode and the top sensor 70 signals a temperature of 115 degrees F. A significant amount of water is drawn out of the tank 24 ("significant" having been predefined in the processor) and the sensor 74 senses a temperature change. The controller 56 starts an ignition sequence and increases the set-point to 125 degrees F. Temperature at the top 40 of the tank increases slowly until it reaches 125 degrees F. and the burner is shut down. The shut-off set-point is restored to 120 degrees F. with a 10-degree F. differential.

The processor 134 can control operation of the FV sensor 78, for example, by keeping a running average of the FV sensor resistance. The running average could be updated, for example, each time the controller 56 performs a start-up. In another configuration, the running average may be updated every 24 hours. A running average of, for example, the last ten resistance measurements could be used to establish a new FV sensor resistance level. A change, for example, of 20 percent or more in ten seconds or less would cause the controller 56 to disconnect the gas supply and/or perform other function(s) for maintaining a safe condition. Of course, other limits may be placed on the FV sensor 78. For example, if the running average were to reach a predetermined minimum or maximum value, the controller 56 could trigger a shut-down of the heater 20. In an alternate embodiment, the controller 56 could also control activation of peripheral equipment for the appliance, such as an exhaust damper apparatus for preventing the loss of residual heat from the appliance.

In heating systems in which features of the present invention are incorporated, processor logic can be applied to sensor inputs to maintain heater efficiency and safety. The foregoing plug-in transformer provides power for microprocessor control, thus making it unnecessary to install, for example, a 120 VAC line to the water heater to power a processor. Using the above described heating controller can increase available hot water capacity in a heating tank. Since temperature changes occur relatively slowly at the top of the tank, accurate control can be achieved using a surface mount sensor at the top of the tank. In prior-art systems having an immersion sensor at the bottom of the tank, time must pass before water at the bottom registers a full temperature differential and thus before heating is initiated. Using an water-draw sensor in accordance with the foregoing embodiments can make more hot water available than would be available in a heater having standard temperature sensors at the bottom. There is no longer a need to prevent temperature stacking within the tank, and so hot water capacity can be increased. Because water temperature at the top of the tank is precisely controlled, chances of heating the water to excessively high temperatures are greatly reduced. Additionally, surface-mount sensing of water temperature is less costly and more efficient than immersion sensing.

The foregoing FV sensor control method can compensate for gradual ageing of a sensor due to its chemistry or due to environmental causes. The foregoing control method also allows a heating system to be shut down more quickly than previously possible in the event of a rapid sensor change. Configurations of the present apparatus and methods can allow a heating system to meet new high efficiency and safety standards applicable to atmospheric gas water heaters. Additionally, a prior art atmospheric gas water heater can be easily replaced with a new lower-voltage water heater in accordance with one or more embodiments of the present invention. Such replacement involves performing the simple additional steps of plugging in the foregoing transformer into a nearby line voltage receptacle and connecting the transformer to the foregoing controller.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A gas-fired water heater having a burner that heats water in a tank, the water heater comprising:

means for stepping down a line voltage from a line voltage receptacle remote from the tank to provide a stepped down voltage;

means for using the stepped down voltage to provide a low voltage lower than the stepped down voltage; and means for using the low voltage to sense a plurality of conditions pertaining to the heater and to control heater operation based on the sensed conditions, said means using the low voltage comprising:

means for determining whether water is drawn from the tank; and means for increasing a heating set-point based on the determining.

2. The water heater of claim 1 wherein the means for determining whether water is drawn from the tank comprises means for determining a temperature at a top of the tank and near a cold water inlet of the tank.

3. The water heater of claim 1 wherein the means for determining whether water is drawn from the tank comprises means for determining a temperature at a top of the tank and near a cold water pipe fitting of the tank.

4. A gas-fired water heater having a burner that heats water in a tank, the water heater comprising:

means for stepping down a line voltage from a line voltage receptacle remote from the tank to Provide a stepped down voltage;

means for using the stepped down voltage to provide a low voltage lower than the stepped down voltage; and means for using the low voltage to sense a plurality of conditions pertaining to the heater and to control heater operation based on the sensed conditions, said means using the low voltage comprising:

means for sensing flammable vapor; and means for shutting off the heater based on an average resistance in the means for sensing flammable vapor.

5. An apparatus for controlling a gas-fired water heater having a tank, the apparatus comprising:

a controller; and a plug-in transformer that steps down a line voltage to provide a stepped-down voltage to the controller;

wherein the transformer is plugged into a line voltage source remote from the controller;

the controller comprising a processor that draws a low voltage to control heater operation, and a circuit that draws the stepped-down voltage to provide the low voltage to the processor and operating power to at least one of an igniter and a gas valve of the heater;

the apparatus further comprising:

a temperature sensor that senses temperature near the top of the tank; and a water-draw sensor configured to sense water being drawn from the tank;

the processor configured to control heater operation based on input from the sensors.

6. The apparatus of claim 1 wherein the water-draw sensor comprises a surface-mounted temperature sensor near the bottom of the tank.

7. The apparatus of claim 1 wherein the water-draw sensor comprises a surface-mounted temperature sensor near a cold water inlet.

8. The apparatus of claim 1 wherein the water-draw sensor comprises a surface-mounted temperature sensor near a cold water pipe fitting.

9. The apparatus of claim 1 wherein the processor is configured to:

use the water-draw sensor to determine whether water is being drawn out of the tank;

increase a heating set-point based on the determining; and call for heat until the temperature sensor indicates that the slightly increased set-point has been reached.

10. The apparatus of claim 9 wherein to increase a heating set-point comprises to increase the set-point by between 1 and 2 degrees F.

11. An apparatus for controlling a gas-fired water heater having a tank, the apparatus comprising:

a controller having a processor; and a plug-in transformer that steps down a line voltage to provide a stepped-down voltage to the controller;

wherein the transformer is plugged into a line voltage source remote from the controller and remote from the tank;

the apparatus further comprising a flammable vapor (FV) sensor, the processor configured to:

determine an average resistance of the FV sensor over a predetermined period; and control heater operation based on the average resistance.

12. The apparatus of claim 11 configured to shut down the heater if the average resistance reaches a predetermined value.

13. A processor-implemented method of operating a gas-fired water heater comprising:

determining whether water is being drawn out of a tank of the heater;

increasing a heating set-point based on the determining; and calling for heat until the increased set-point has been reached.

14. The method of claim 13 wherein determining whether water is being drawn out comprises determining whether cold water is entering the tank.

15. The method of claim 14 wherein determining whether cold water is entering comprises sensing a temperature drop using a temperature sensor.

16. The method of claim 13 wherein increasing a heating set-point comprises increasing the set-point by between one and two degrees F.

17. A gas-fired water heater having a burner that heats water in a tank, the system comprising:

means for stepping down a line voltage from a line voltage receptacle remote from the tank to provide a stepped down voltage;

means for using the stepped down voltage to provide a low voltage lower than the stepped down voltage; and means for using the low voltage to sense a plurality of conditions pertaining to the heater and to control heater operation based on the sensed conditions, the means for using the low voltage comprising:

means for determining whether water is drawn from the tank; and means for increasing a heating set-point based on the determining;

the means for determining whether water is drawn from the tank comprising means for determining a temperature at a top of the tank and near a cold water inlet of the tank.

18. A gas-fired water heater having a burner that heats water in a tank, the system comprising:

means for stepping down a line voltage from a line voltage receptacle remote from the tank to provide a stepped down voltage;

means for using the stepped down voltage to provide a low voltage lower than the stepped down voltage; and means for using the low voltage to sense a plurality of conditions pertaining to the heater and to control heater operation based on the sensed conditions, the means for using the low voltage comprising:

means for determining whether water is drawn from the tank; and means for increasing a heating set-point based on the determining;

the means for determining whether water is drawn from the tank comprising means for determining a temperature at a top of the tank and near a cold water pipe fitting of the tank.

19. A gas-fired water heater having a burner that heats water in a tank, the system comprising:

means for stepping down a line voltage from a line voltage receptacle remote from the tank to provide a stepped down voltage;

means for using the stepped down voltage to provide a low voltage lower than the stepped down voltage; and means for using the low voltage to sense a plurality of conditions pertaining to the heater and to control heater operation based on the sensed conditions;

the means for using the low voltage comprising:

means for sensing flammable vapor; and means for shutting off the heater based on an average resistance in the means for sensing flammable vapor.

20. An apparatus for controlling a gas-fired water heater having a tank, the apparatus comprising:

a controller; and a plug-in transformer that steps down a line voltage to provide a stepped-down voltage to the controller;

wherein the transformer is plugged into a line voltage source remote from the controller;

the controller comprising:

a processor that draws a low voltage to control heater operation; and a circuit that draws the stepped-down voltage to provide the low voltage to the processor and operating power to at least one of an igniter and a gas valve of the heater;

the apparatus further comprising:

a temperature sensor that senses temperature near the top of the tank; and a water-draw sensor configured to sense water being drawn from the tank;

the processor configured to control heater operation based on input from the sensors.

21. The apparatus of claim 20 wherein the water-draw sensor comprises a surface-mounted temperature sensor near the bottom of the tank.

22. The apparatus of claim 20 wherein the water-draw sensor comprises a surface-mounted temperature sensor near a cold water inlet.

23. The apparatus of claim 20 wherein the water-draw sensor comprises a surface-mounted temperature sensor near a cold water pipe fitting.

24. The apparatus of claim 20 wherein the processor is configured to:

use the water-draw sensor to determine whether water is being drawn out of the tank;

increase a heating set-point based on the determining; and call for heat until the temperature sensor indicates that the increased set-point has been reached.

25. The apparatus of claim 24 wherein to increase a heating set-point comprises to increase the set-point by between 1 and 2 degrees F.

26. An apparatus for controlling a gas-fired water heater having a tank, the apparatus comprising:

a controller; and a plug-in transformer that steps down a line voltage to provide a stepped-down voltage to the controller;

wherein the transformer is plugged into a line voltage source remote from the controller and remote from the tank;

the apparatus further comprising a flammable vapor (FV) sensor, the processor configured to:

determine an average resistance of the FV sensor over a predetermined period; and control heater operation based on the average resistance.

27. The apparatus of claim 26 configured to shut down the heater if the average resistance reaches a predetermined value.

* * * * *

UNITED STATES PATENT AND TRADEMARK OFFICE

CERTIFICATE OF CORRECTION

PATENT NO. : 7,032,542 B2
APPLICATION NO. : 10/863319
DATED : April 25, 2006
INVENTOR(S) : Donald E. Donnelly, Thomas P. Buescher and Michael Somorov It is certified that error appears in the above-identified patent and that said Letters Patent is hereby corrected as shown below:

Column 6:

In Claim 6, change "1" to "5"
In Claim 7, change "1" to "5"
In Claim 8, change "1" to "5"
In Claim 9, change "1" to "5"

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,032,542 B2
APPLICATION NO. : 10/863319
DATED : April 25, 2006
INVENTOR(S) : Donald E. Donnelly, Thomas P. Buescher and Michael Somorov It is certified that error appears in the above-identified patent and that said Letters Patent is hereby corrected as shown below:

Column 6:

In Claim 6, line 5, change "1" to "5"
In Claim 7, line 8, change "1" to "5"
In Claim 8, line 11, change "1" to "5"
In Claim 9, line 14, change "1" to "5"

This certificate supersedes the Certificate of Correction issued February 9, 2010.

Signed and Sealed this

Ninth Day of March, 2010

David J. Kappos

David J. Kappos
*Director of the United States Patent and Trademark Office*